US006505556B2

(12) United States Patent
Miyauti

(10) Patent No.: US 6,505,556 B2
(45) Date of Patent: Jan. 14, 2003

(54) PLATE-MAKING AND MOUNTING CONTROL SYSTEM FOR A MULTIPLE-UNIT PRINTING PRESS

(75) Inventor: Chuuji Miyauti, Tokyo (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/948,546

(22) Filed: Sep. 10, 2001

(65) Prior Publication Data

US 2002/0050216 A1 May 2, 2002

(30) Foreign Application Priority Data

Oct. 30, 2000 (JP) ..... 2000-330399

(51) Int. Cl.[7] ..... B41M 5/00

(52) U.S. Cl. ..... 101/463.1; 101/477; 101/485; 101/486

(58) Field of Search ..... 101/141, 132, 101/136, 477, 484, 485, 486, DIG. 36, 483, 494, 401.1, 463.1; 33/614, 617–621

(56) References Cited

U.S. PATENT DOCUMENTS 5,377,590 A * 1/1995 Bolza-Schunemann et al. .. 101/382.1
5,850,789 A * 12/1998 Rudolf et al. ..... 101/486
6,076,464 A * 6/2000 Okamura ..... 101/401.1
6,247,404 B1 * 6/2001 Okamura ..... 101/401.1
6,257,141 B1 * 7/2001 Hashimoto et al. ..... 101/477

FOREIGN PATENT DOCUMENTS

JP 10-202840 8/1998

* cited by examiner

*Primary Examiner*—Andrew H. Hirshfeld
*Assistant Examiner*—Minh Chau
(74) *Attorney, Agent, or Firm*—Rader, Fishman & Grauer PLLC

(57) ABSTRACT

A printing press for newspaper production comprises several printing units each having two plate cylinders for concurrently printing on both sides of a web, each plate cylinder having several predefined plate-mounting positions. The control system includes an assignment controller for putting out ASSIGNMENT INFO indicative of how all the printing plates to made for each newspaper issue are assigned to the plate-mounting positions on the plate cylinders. A plate-maker controller provides CONTENTS INFO indicative of at least the page number of each printing plate being made. In response to the ASSIGNMENT INFO and CONTENTS INFO a printer controller produces POSITION INFO indicative of the desired plate-mounting positions on each plate cylinder to which the printing plates are to be mounted, causing a printer to print the POSITION INFO on each printing plate that has been made. After the printing plates are mounted to the plate cylinders, the POSITION INFO printings thereon are read by respective readers, which thereupon put out the POSITION INFO readings together self-identificatory READER INFO. Whether each printing plate is mounted to the correct position on the correct plate cylinder is determined on the bases of the POSITION INFO read therefrom and the READER INFO.

7 Claims, 2 Drawing Sheets

PLATE-MAKING AND MOUNTING CONTROL SYSTEM FOR A MULTIPLE-UNIT PRINTING PRESS

BACKGROUND OF THE INVENTION

1. Field of the Invention

This invention relates to printing presses, to a web-fed printing press, and particularly to that having a plurality of printing units each having at least one plate cylinder capable of carrying a plurality of printing plates in preassigned longitudinal positions thereon. More particularly, the invention pertains to a system for controlling the making of a set of printing plates, as for each newspaper issue, and the subsequent mounting thereof to the preassigned positions on the plate cylinder or cylinders of each printing unit, with a view to making sure that the printing plates are all mounted in the correct positions.

2. Description of the Prior Art

A web-fed rotary printing press for newspaper production usually incorporates from three to ten paper supply units, as many printing units, and one folding unit. Paid off from their rolls in the supply units, the webs of paper are printed on both sides, in either monochrome or multiple colors, by the printing units, then superposed one upon another, and then cut and folded into signatures of multiple pages in the folding unit.

In today's large newspaper production plants, moreover, several printing press systems, each composed of the noted combination of supply units and printing units and folding unit, are put to conjoint operation. Typically, each printing unit is of the well-known offset perfecting press design, having two plate cylinders and two blanket cylinders for concurrently printing both sides of the web. Each such printing unit of each press system permits the mounting, at one time, of up to as many as sixteen so-called "broad size" printing plates. A formidably large number of printing plates are thus employed for production of each newspaper issue. All such printing plates must of course be mounted in the correct positions on the correct plate cylinders.

The trouble is that human labor is yet relied upon for mounting such huge numbers of printing plates to the plate cylinders. The human labor grows heavier, furthermore, as news are updated hour by hour, minute by minute, even during the progress of newspaper production, demanding the mounting of new printing plates for each latest edition. Even greater numbers of printing plates are required as the newspaper contents usually differ for different areas of distribution. Actually, substantive wastes of paper have frequently occurred as a result of the mounting of printing plates in wrong positions on the plate cylinders or even to wrong plate cylinders.

Attempts have indeed been made to eliminate such mounting errors, a typical one, perhaps closest to the instant invention, being found in Japanese Unexamined Patent Publication No. 10-202840. It teaches to print on each printing plate information as to which plate cylinder, and which position thereon, the plate is to be mounted to. The information is supplied to the printer from a memory on which there is stored all the data necessarily for mounting the complete set of printing plates in the required positions on the required plate cylinders. After the printing plates have been manually mounted, the printings thereon are read and compared with the data stored on the memory.

An objection to this prior art system is that there is printed on the printing plates only the information on the plate cylinders and the positions thereon to which they are to be mounted, with no indication whatsoever as to their contents, that is, the matter to be printed by the plates. It is therefore not clear how the contents of the printing plates are recognized in mounting them to the plate cylinders. The workers must be uncertain whether they are mounting the correct printing plates in the correct positions.

It is not disclosed, either, how the system knows the positions on the plate cylinders in which the printing plates have actually been mounted. A comparison of the readings of the printings on the mounted printing plates with the data stored on the memory provides no firsthand knowledge of whether they are on the correct plate cylinders, and in the correct positions thereon, or not.

An additional objection concerns use of a charge-coupled-device camera for reading the printings on the printing plates. The CCD camera together with associated electronics made the prior art system very expensive. It is mentioned that the CCD camera is replaceable by a barcode reader, but no actual construction is shown in support of this alternative. A barcode reader, moreover, as used in this prior art system in place of the CCD camera, does not resolve the ambiguity pointed out above.

The same unexamined Japanese patent publication also suggests to print on the printing plates barcoded information indicative of which plate cylinder, and which position thereon, each plate is to be mounted to. On being read by a barcode reader, the information is printed again, this time in visually recognizable form, on each printing plate using an ink that does not affect printing. The workers are supposed to mount the printing plates in the required positions on the required plate cylinders by visually observing the printings thereon. After the printing plates are thus mounted, the printings thereon are read by a CCD camera for comparison with the information that has been read by the barcode reader before the plates are mounted.

The twofold reading of the printings on the printing plates necessarily makes reading errors twice as probable as in the case of one reading only. Despite the complex confirmation processes involved, this second prior art method is even more unreliable than the first.

The second prior art method is also akin to the first in failing to teach how the system knows the positions on the plate cylinders in which the printing plates are mounted. A comparison of the barcode readings before the printing plates are mounted and the CCD camera readings after they are mounted is not enough to determine whether each plate is in the correct mounting position or not.

SUMMARY OF THE INVENTION

The present invention seeks to thoroughly defeat the shortcomings and ambiguities of the prior art by providing an improved, totally practicable plate-making and -mounting control system capable of accurately pinpointing any printing plates that are mounted in wrong plate-making positions on any plate cylinders of any printing units.

Another object of the invention is to expedite the manual mounting of printing plates to plate cylinders by providing on the printing plates the printings that are readily recognizable by the workers besides being machine readable, enabling them to visually confirm the required plate-mounting position on the required plate cylinder as they handle each printing plate.

Yet another object of the invention is to reduce the probability of reading errors to a minimum by providing a plate-making and -mounting control system that requires reading of the printings on the printing plates at one time only.

Briefly, the present invention may be summarized as a platemaking and -mounting control system in a rotary printing press for production of multiple-page printings, the press being of the type having at least one plate cylinder with a plurality of predefined plate-mounting positions for having as many printing plates mounted thereto, and a plate maker for making a set of printing plates to be mounted to the preassigned plate-mounting positions on the plate cylinder.

The plate-making and -mounting control system according to the invention comprises an assignment controller which provides, in response to the inputting of a required set of directions for each specific printing job, ASSIGNMENT INFO indicative of how a set of printing plates to be made for the job are assigned to the plate-mounting positions on the plate cylinder. A plate-maker controller is provided for controlling the plate maker making the set of printing plates and for providing CONTENTS INFO indicative of the matter to be printed by each printing plate being made by the plate maker. In response to the ASSIGNMENT INFO from the assignment controller and the CONTENTS INFO from the plate-maker controller, a printer controller provides POSITION INFO indicative of a desired plate-mounting position on the plate cylinder to which each printing plate being made by the plate maker is to be mounted. A printer, under the control of the printer controller, prints the POSITION INFO on each printing plate that has been made by the plate maker.

After the mounting, perhaps by human labor, of the complete set of printing plates to the plate cylinder, the POSITION INFO printings on the printing plates are read by reader means, which thereupon put out the POSITION INFO read from each printing plate, together with READER INFO indicative of the actual plate-mounting position on the plate cylinder in which that printing plate is mounted. Whether each printing plate is mounted to a correct plate-mounting position on the plate cylinder or not is subsequently determined, by control electronics familiar to the specialists, on the bases of both POSITION INFO and READER INFO fed from the reader means.

Thus, as a first advantage gained by the plate-making and -mounting control system summarized above, the POSITION INFO printed on each printing plate is derived from both ASSIGNMENT INFO from the assignment controller and CONTENTS INFO from the plate-maker controller. The POSITION INFO will therefore indicate the desired plate-mounting position on the plate cylinder for each printing plate in exact agreement with the matter to be printed by that printing plate.

Preferably, as in the typical embodiment of the invention to be disclosed subsequently, the printer may be disposed immediately downstream of the plate maker in order to print the POSITION INFO on each printing plate that has just issued therefrom. There can thus be eliminated the risk of the POSITION INFO being printed on wrong printing plates.

Another pronounced advantage of the invention is that, on reading the POSITION INFO printing on each printing plate on the plate cylinder, the reader means put out the POSITION INFO reading together with the READER INFO uniquely identifying the particular plate-mounting position on the particular plate cylinder in which that printing plate is mounted. In short the output from the reader means tells which plate-mounting position on which plate cylinder the printing plate from which the POSITION INFO has been recovered is mounted in. The POSITION INFO reading in combination with the READER INFO makes it possible to infallibly determine whether each printing plate is mounted in the correct plate-mounting position on the correct plate cylinder or not.

It will also be appreciated that the printings on the printing plate are read only once according to the invention. The probability of reading errors is thus minimized.

According to an additional feature of the invention, the POSITION INFO printings on the printing plates are provided both in machine decipherable form, such as barcode, and in human discernible form, such as letters and numerals. The human discernible printings are intended to facilitate the manual mounting of the printing plates. The barcode printings are preferred because of the simplicity and inexpensiveness of the facilities required for reading.

The above and other objects, features and advantages of this invention will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
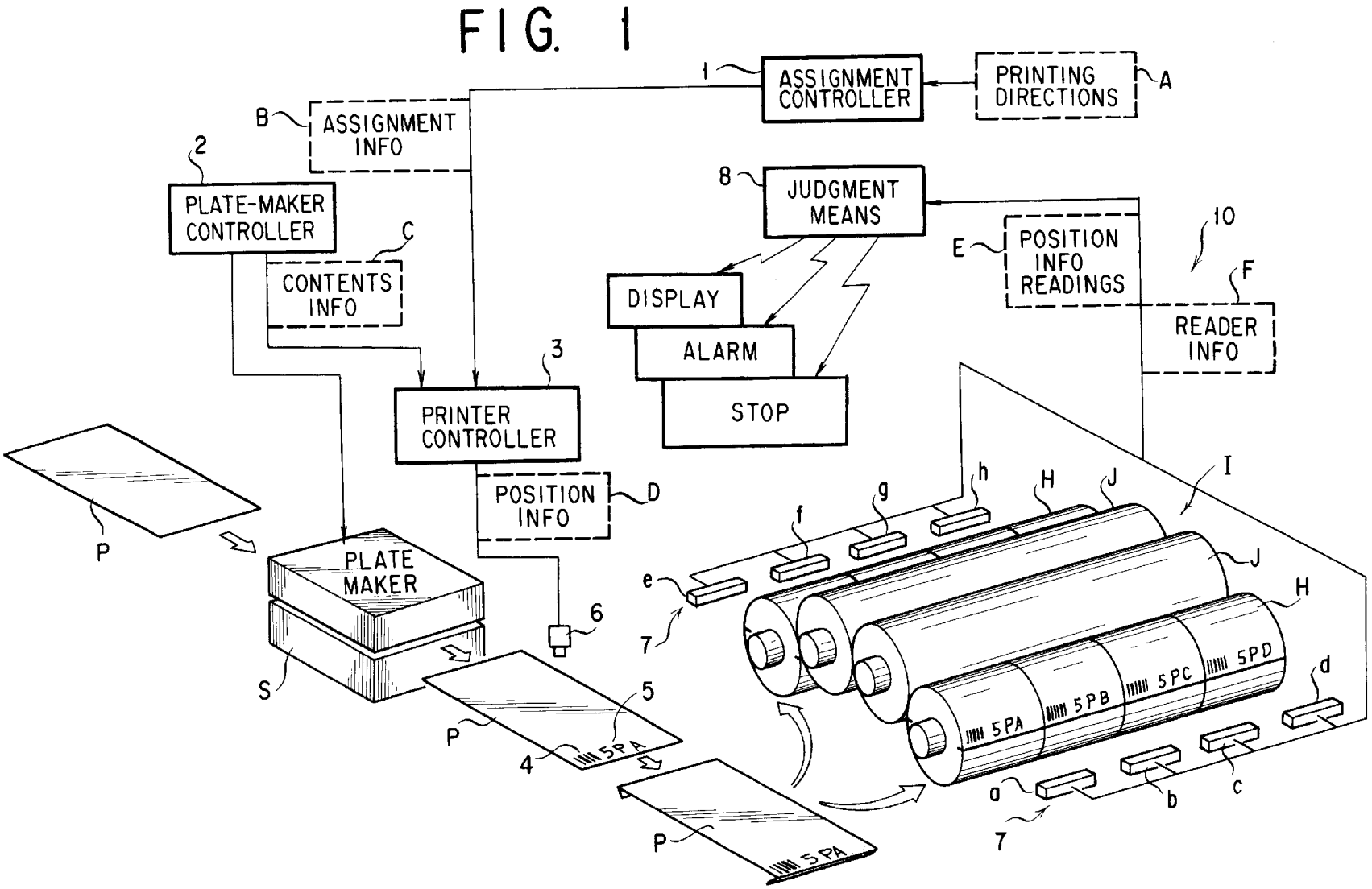
FIG. 1 shows, partly in perspective and partly in block-diagrammatic form, the plate-making and -mounting control system embodying the principles of this invention.

The invention is believed to be best applicable to a web-fed printing press for newspaper production having a plurality of, usually from three to ten, printing units which are each of the familiar offset perfecting press design for concurrently printing on both sides of a web of paper using the blanket-to-blanket method of transferring the printed impressions to the web. FIG. 1 shows one such printing unit I having two plate cylinders H and two blanket cylinders J of conventional arrangement. The plate cylinders H print the inked images on the surfaces of the rubber blankets on the blanket cylinders J, from which the images are offset or transferred to the opposite sides of the web, not shown, as it passes between the two blanket cylinders.

Typically, each plate cylinder H has four plate-mounting positions each for carrying two printing plates P at a maximum. Having two such plate cylinders, each printing unit I is capable of handling up to sixteen "broad" printing plates P at one time. In FIG. 1 the four plate-mounting positions on one plate cylinder of the illustrated printing unit are shown to have self-identificatory markings 5P-A to 5P-D, respectively, it being understood that the four plate-mounting positions on the other plate cylinder has their own self-identificatory markings, as from 5P-E to 5P-H, respectively.

In the following discussion of the representative plate-making and -mounting control system according to the invention, a total of eight printing plates P are assumed to be mounted to the preassigned platemounting positions 5P-A through 5P-H on the two plate cylinders H in this representative printing unit I. The control system is intended to expedite the manual mounting of the printing plates P in the correct plate-mounting positions on each correct plate cylinder H in each correct printing unit I and, after the mounting of the printing plates, to examine whether they are all in the correct positions or not.

Generally designated 10 in FIG. 1, the plate-making and -mounting control system comprises:

1. An assignment controller 1 for putting out, in response to the inputting of a mandatory set of printing directions A for each specific printing job, ASSIGNMENT INFO B indicative of how a set of printing plates P to be made for the job are assigned to the plate-mounting positions on any required plate cylinders H.
2. A plate-maker controller 2 for controlling a plate maker S making the set of printing plates P and for putting out CONTENTS INFO C indicative of the matter to be printed by each printing plate P, the CONTENTS INFO including the page number of each printing plate being made by the plate maker S.
3. A printer controller 3 for putting out POSITION INFO D indicative of the desired plate-mounting position on the desired plate cylinder to which each printing plate being made by the plate maker S is to be mounted, in response to the ASSIGNMENT INFO B from the assignment controller 1 and the CONTENTS INFO C from the plate-maker controller 2.
4. A printer 6 disposed next to the plate maker S and controlled by the printer controller 3 for printing on each printing plate that has been just made by the plate maker S the POSITION INFO D in both machine-decipherable form 4 and human-discernible form 5.
5. Reader means 7 for reading the POSITION INFO printing on each printing plate P after the printing plates have been mounted to the plate cylinders H, and for putting out the POSITION INFO reading E recovered from each printing plate, together with READER INFO F indicative of the actual plate-mounting position on the actual plate cylinder to which that particular printing plate has been mounted.
6. Judgment means 8 for ascertaining from the POSITION INFO readings E and READER INFO F from the reader means 7 whether each printing plate is mounted to the correct plate-mounting position on the correct plate cylinder or not.

The above enumerated major components of the plate-making and -mounting control system will be explained in more detail hereinbelow under the separate headings. Operational description will follow the explanation of the listed components.

Assignment Controller

The press supervisor or operator is supposed to input the set of printing directions A for each specific job, such as the production of each newspaper issue, to be implemented by the press. Such printing directions A include those specifying which of all the printing units of the press are to be put to use for the job. Each time such a set of printing directions A are input, or a modification or amendment made in the directions, the assignment controller 1 creates, modifies or amends and puts out the ASSIGNMENT INFO B assigning to each plate-mounting position on each plate cylinder H of each printing unit I the printing plate P bearing the image to be printed in that particular position.

Plate-Maker Controller

Besides being capable of electronically controlling the plate maker S, the plate-maker controller 2 delivers to the printer controller 3 the CONTENTS INFO C indicative of the matter or image to be printed by each printing plate P being made by the plate maker S. The CONTENTS INFO should be easy of machine comprehension, so that page numbers are recommended as the CONTENTS INFO.

Printer Controller

The printer controller 3 is electrically connected to both the assignment controller 1 and the plate-maker controller 2 for inputting the ASSIGNMENT INFO B and the CONTENTS INFO C therefrom. The complete ASSIGNMENT INFO B is to be delivered to the printer controller 3 as the printing directions A are input to the assignment controller 1. The CONTENTS INFO C, on the other hand, is to be input to the printer controller 3 unit by unit in prescribed time relationship to the production of each printing plate by the plate maker S; that is, as each printing plate is made by the plate maker, one CONTENTS INFO unit concerning that particular plate will be delivered to the printer controller.

In response to the ASSIGNMENT INFO, and to each CONTENTS INFO unit concerning the printing plate being made, the printer controller 3 puts out the POSITION INFO D in agreement with the matter to be printed by that printing plate, the POSITION INFO being indicative as aforesaid of the desired plate-mounting position on the desired plate cylinder to which the printing plate must be mounted..

Printer

Figure 2:
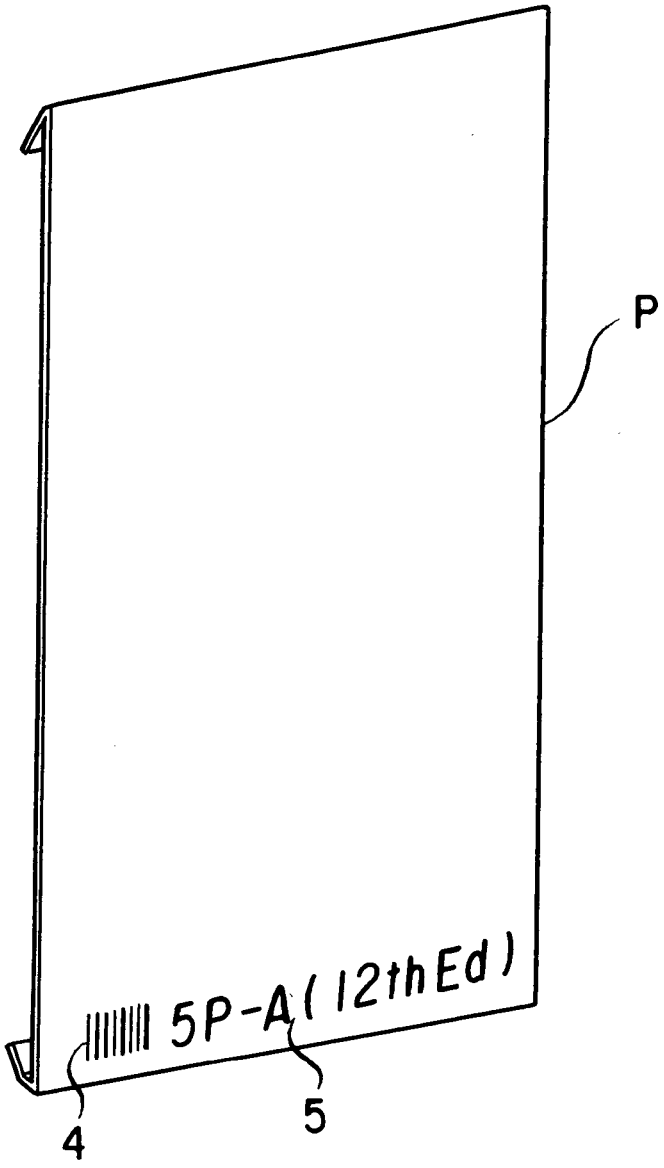
FIG. 2 is an enlarged perspective view of one of the printing plates being handled by the FIG. 1 system, the printing plate having the POSITION INFO printed thereon in both machine and human-readable forms.

Disposed in the immediate vicinity of the plate maker S, the printer 6 prints the POSITION INFO D from the printer controller 3 on each printing plate P as the latter has just issued from the plate maker. FIG. 2 illustrates on an enlarged scale one such printing plate P on which has been printed the POSITION INFO in both machine-readable form 4 and human-readable form 5. The machine-readable printing 4 is shown as barcode, and the human-readable printing 5 as letters and numerals. Use of a hydrophilic ink is desirable for these printings 4 and 5, as such ink is readily erasable after the printing plates have been mounted to the plate cylinders and checked according to the invention to be in the correct positions. An ink-jet printer is a preferred example of printer for use with a hydrophilic ink.

The printing of the POSITION INFO D in the form of barcode is not an essential feature of the invention. The barcode printing 4 may be eliminated altogether, with only the letter-and-numeral printing 5 left. Even then the printing 5 will be read by CCD cameras or like devices capable of character recognition. The barcode printing 4 is nevertheless preferred because barcode readers are far less expensive than CCD cameras.

Reader Means

The reader means 7 take the form of barcode readers a–h in this embodiment of the invention for reading the barcoded POSITION INFO printings 4 on the printing plates P after these plates have been mounted to the plate cylinders H. It is understood that the workers relied upon the human-readable POSITION INFO printings 5 on the printing plates P in mounting them.

Since four printing plates P are now assumed to be mounted to each of the two plate cylinders H of this printing unit I, four barcode readers a–d or e–h are shown disposed one opposite each plate-mounting position on each plate cylinder. Reading the barcoded POSITION INFO printing 4 on one confronting printing plate P when the plate cylinders H are in low-speed rotation at the start of printing, each barcode reader puts out the POSITION INFO reading E together with the READER INFO F.

The READER INFO F in this case is self-identificatory data that are preassigned to the respective barcode readers a–h to uniquely designate their positions relative to the plate-mounting positions on the plate cylinders H. Thus the POSITION INFO reading E from the first barcode reader a, for instance, can be identified as being from the printing plate in the first plate-mounting position 5P-A on the first plate cylinder on the basis of the self-identificatory READER INFO F from the first barcode reader.

Judgment Means

The judgment means 8 input the POSITION INFO reading E from each barcode reader together with the self-identificatory READER INFO F therefrom. From comparison of these inputs the judgment means 8 can ascertain whether each printing plate P is mounted to the correct plate-mounting position on the correct plate cylinder H. As indicated in FIG. 1, the judgment means 8 may include a display for visually indicating the results of printing plates examination, an alarm for visually or audibly warning the supervisor about a mismounting or mismountings, if any, and means for automatically stopping the press in the presence of a mismounting.

Operation

Although the operation of the illustrated plate-making and -mounting control system is considered apparent from the foregoing, further amplification will be made in the following brief summary of such operation. The required set of directions A may be input to the assignment controller 1 preparatory to production of each newspaper issue. Based on the input printing directions, the assignment controller 1 will edit and issue the ASSIGNMENT INFO B assigning all the printing plates to be made for the job, to the specific plate-mounting positions on the specific plate cylinders H of the specific printing units I. The ASSIGNMENT INFO B will be delivered to the printer controller 3.

Also delivered to the printer controller 3 is the CONTENTS INFO C from the plate-maker controller 2, under the direction of which the printing plates P are being made by the plate maker S. The CONTENTS INFO in this case indicates at least the page number of each printing plates P being made by the plate maker S. Each time one CONTENTS INFO unit is input from the plate-maker controller 2, the printer controller 3 will refer that unit to the ASSIGNMENT INFO B which has already been input from the assignment controller 1, and put out the POSITION INFO D for delivery to the printer 6. The desired mounting position thus indicated by the POSITION INFO for the printing plate being made at that time by the plate maker S will be in exact conformity with the matter to be printed by that printing plate.

With the emergence of each new printing plate P from the plate maker S, the printer controller 3 will cause the printer 6 to print the POSITION INFO D in a prescribed position thereon. The POSITION INFO will be printed as aforesaid both in barcode 4 and in characters 5. There will be no risk of the POSITION INFO being printed on wrong printing plates if the printer 6 lies immediately downstream of the plate maker S with respect to the arrow-marked traveling direction of the plates P past the plate maker.

The foregoing cycle of plate-making and POSITION INFO printing will be repeated until all the printing plates needed for the job are completed. After having their opposite ends bent to provide the familiar mounting flanges as shown in FIG. 2, the printing plates P may be transported to the vicinities of the printing units. Then the plates may be mounted to the preassigned positions on the preassigned plate cylinders H by the workers.

In so mounting the printing plates P the workers may read the human-readable POSITION INFO printings thereon, such as "5P-A ($12^{th}$ Ed.)" indicated in FIG. 2, to make sure that they are mounting them correctly. Reliance on these printings is believed to reduce mounting errors to a minimum.

After the mounting of all the printing plates P comes the confirmation that they are all in the correct positions on the correct cylinders. As the press is set into operation, all the barcode readers a–h of each printing unit I will read the barcoded POSITION INFO printings 4 on the printing plates P on the slowly revolving plate cylinders H. The barcode readers a–h will deliver to the judgment means 8 the barcoded POSITION INFO readings E from the associated printing plates P, together with the self-idenficatory READER INFO F.

The judgment means 8 will decode the barcoded POSITION INFO reading E from each printing plate P to ascertain which plate-mounting position on which plate cylinder in which printing unit that printing plate is assigned to. Further, from the READER INFO F accompanying that POSITION INFO reading E, the judgment means 8 will know which plate-mounting position on which plate cylinder in which printing unit that POSITION INFO was read from. Thus will the judgment means 8 judge whether each printing plate P is correctly mounted or not.

The results of such judgment will be visually and/or audibly informed to the supervisor, and the press automatically set out of operation if necessary. Being formed with a hydrophilic ink, the POSITION INFO printings 4 and 5 on the printing plates P will be erased as the plates are damped for offset printing.

The need may arise, as frequently does in day-to-day production of newspapers, to change some of the printing plates in the course of printing. Such new printing plates may be mounted to the plate cylinder or cylinders through the same procedure as above. The judgment means 8 of the FIG. 1 system 10 will then determine whether the new plates are correctly positioned or not, from the barcoded POSITION INFO readings E and READER INFO F from the associated barcode readers.

Notwithstanding the foregoing detailed disclosure, it is not desired that the present invention be limited by the exact showing of the drawings or the description thereof. For example, instead of providing the barcode readers a–h, or equivalent devices, one for each plate-mounting position on each plate cylinder, only one such device may be provided for each plate cylinder and made movable from one plate-mounting position to the next. In each such position the movable reading device may put out the POSITION INFO reading together READER INFO indicating the position where the POSITION INFO was read.

This and other modifications, alterations and adaptations of the illustrated embodiment are intended in the foregoing disclosure. It is therefore appropriate that the invention be construed broadly and in a manner consistent with the fair meaning or proper scope of the subjoined claims.

What is claimed is:

1. In a rotary printing press for production of multiple-page printings, the press including at least one plate cylinder having a plurality of predefined plate-mounting positions for having as many printing plates mounted thereto, and a plate maker for making a set of printing plates to be mounted to the plate-mounting positions on the plate cylinder, a plate-making and -mounting control system comprising:

(a) an assignment controller for providing, in response to inputting of a required set of printing directions for each printing job, ASSIGNMENT INFO indicative of how a set of printing plates to be made for the job are assigned to the plate mounting positions on the plate cylinder;

(b) a plate-maker controller for controlling a plate maker making the set of printing plates and for providing CONTENTS INFO indicative of the matter to be printed by each printing plate being made by the plate maker;

(c) a printer controller for providing POSITION INFO indicative of a desired plate-mounting position on the plate cylinder to which each printing plate being made by the plate maker is to be mounted, in response to the ASSIGNMENT INFO from the assignment controller and the CONTENTS INFO from the plate-maker controller;

(d) a printer for printing, under the control of the printer controller, the POSITION INFO on each printing plate that has been made by the plate maker;

(e) reader means for reading the POSITION INFO printing on each printing plate after the latter has been mounted to the plate cylinder, and for putting out the POSITION INFO reading recovered from each printing plate, together with READER INFO indicative of an actual plate-mounting position on the plate cylinder to which that printing plate is mounted; and (f) judgment means for judging whether each printing plate is mounted to a correct plate-mounting position on the plate cylinder, on the bases of the POSITION INFO reading and the READER INFO fed from the reader means.

2. The plate-making and -mounting control system of claim 1 wherein the reader means comprises a plurality of readers disposed one adjacent each plate-mounting position on the plate cylinder, each reader putting out the POSITION INFO reading recovered from one printing plate on the plate cylinder, together with self-identificatory data as the READER INFO.

3. The plate-making and -mounting control system of claim 1 wherein the POSITION INFO is printed on each printing plate in both machine decipherable and human discernible forms.

4. The plate-making and -mounting control system of claim 1 wherein the POSITION INFO is printed using a hydrophilic ink.

5. The plate-making and -mounting control system of claim 1 wherein the CONTENTS INFO includes at least the page number of each printing plate.

6. In a rotary printing press for production of multiple-page printings, the press including a plurality of printing units each having a plate cylinder with a plurality of predefined plate-mounting positions for having as many printing plates mounted thereto, and a plate maker for making a set of printing plates to be mounted to the plate-mounting positions of the plate cylinder of each printing unit, a plate-making and -mounting control system comprising:

(a) an assignment controller for providing, in response to inputting of printing directions including which printing units are to be put to use, ASSIGNMENT INFO indicative of a set of printing plates to be made for the plate cylinder of each printing unit to be put to use, and of how the printing plates are assigned to the plate-mounting positions on the plate cylinder;

(b) a plate-maker controller for controlling a plate maker making the printing plates and for providing CONTENTS INFO indicative of matter to be printed by each printing plate being made by the plate maker;

(c) a printer controller for providing POSITION INFO indicative of a desired plate-mounting position on the plate cylinder of each chosen printing unit to which each printing plate being made by the plate maker is to be mounted, in response to the ASSIGNMENT INFO from the assignment controller and the CONTENTS INFO from the plate-maker controller;

(d) a printer for printing, under the control of the printer controller, the POSITION INFO on each printing plate that has been made by the plate maker;

(e) reader means for reading the POSITION INFO printing on each printing plate after the latter has been mounted to the plate cylinder of any chosen printing unit, and for putting out the POSITION INFO reading recovered from each printing plate, together with READER INFO indicative of an actual plate-mounting position on the plate cylinder of each chosen printing unit to which that printing plate is mounted; and (f) judgment means for judging whether each printing plate is mounted to a correct plate-mounting position on the plate cylinder of a correct printing unit, on the bases of the POSITION INFO reading and READER INFO fed from the reader means.

7. The plate-making and -mounting control system of claim 6 wherein each printing unit is of offset perfecting press construction having a pair of plate cylinders for concurrently printing on both sides of a web, and wherein the reader means comprises a plurality of readers disposed one opposite each plate-mounting position on each plate cylinder of each printing unit, each reader putting out the POSITION INFO reading recovered from one printing plate on one plate cylinder, together with self-identificatory data as the READER INFO.

* * * * *